US008708866B2

(12) United States Patent
Spevak

(10) Patent No.: US 8,708,866 B2
(45) Date of Patent: Apr. 29, 2014

(54) ABS-CYCLE

(76) Inventor: Jakob Spevak, Haifa (IL)

( * ) Notice: Subject to any disclaimer, the term of this patent is extended or adjusted under 35 U.S.C. 154(b) by 363 days.

(21) Appl. No.: 13/189,922

(22) Filed: Jul. 25, 2011

(65) Prior Publication Data

US 2013/0029809 A1 Jan. 31, 2013

(51) Int. Cl.

| | |
|---|---|
| ***A63B 22/06*** | (2006.01) |
| ***A63B 22/12*** | (2006.01) |
| ***A63B 69/16*** | (2006.01) |
| ***A63B 26/00*** | (2006.01) |

(52) U.S. Cl.

USPC ..... 482/63; 482/57; 482/62; 482/140

(58) Field of Classification Search

USPC ..... 482/51, 53–54, 57–64, 71–73, 78, 91, 482/110, 121–140

See application file for complete search history.

(56) References Cited

U.S. PATENT DOCUMENTS

| | | | | |
|---|---|---|---|---|
| 1,507,554 | A * | 9/1924 | Cooper | 482/57 |
| 3,662,747 | A * | 5/1972 | Williams | 601/5 |
| 3,744,794 | A * | 7/1973 | Gause et al. | 482/57 |
| 5,114,391 | A * | 5/1992 | Pitzen et al. | 482/62 |
| 5,449,334 | A * | 9/1995 | Kingsbury | 482/57 |
| 6,270,446 | B1 * | 8/2001 | Abelbeck et al. | 482/57 |
| 6,682,462 | B1 * | 1/2004 | Lee | 482/72 |
| 7,588,518 | B2 * | 9/2009 | LaStayo et al. | 482/63 |
| 8,206,272 | B2 * | 6/2012 | Greene | 482/57 |
| 2003/0166435 | A1 * | 9/2003 | Arad | 482/57 |
| 2010/0210425 | A1 * | 8/2010 | Bowser | 482/62 |
| 2011/0086743 | A1 * | 4/2011 | Stewart | 482/52 |
| 2011/0245043 | A1 * | 10/2011 | Mitchell | 482/62 |

* cited by examiner

*Primary Examiner* — Oren Ginsberg
*Assistant Examiner* — Joshua Lee
(74) *Attorney, Agent, or Firm* — Michael N. Cohen; Cohen I.P. Law Group P.C.

(57) ABSTRACT

An exercise machine adaptable to perform a cardiac workout and an abdominal workout simultaneously includes a frame structure, a resistance provider, a pair of pedals, a first sprocket, a second sprocket, a sprocket rotating means, an axis, an engaging means, a cable, a seat, an elastic band, a pair of shoulder straps, a monitor and a pulley system. The sprocket rotating means allows the first sprocket to engage and disengage with the exercise bike. The pedaling of the pedals allows the user to perform the cardiac workout. The pair of shoulder straps designed to insert along the shoulders of the user is connected to the cable and creates a tensional force thereon by getting stretched with the pedaling of the pedals. The tensional force pulls the user backward and the user in turn resists the backward movement by manually contracting abdominal muscles to perform the abdominal workout.

20 Claims, 3 Drawing Sheets

ABS-CYCLE

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to exercise machines, and more particularly to an improved exercise machine that provides a cardiac workout and an abdominal workout simultaneously.

DISCUSSION OF RELATED ART

Today, people are keenly aware about the importance of physical fitness in their daily life. Physical fitness encourages good health, a balanced body weight and a positive attitude towards life. Gyms and fitness centers are excellent places to achieve physical fitness where a wide variety of exercise machines are available. Home exercise equipment is also available to allow an individual to workout at home. Equipment like treadmills, steppers, exercise bikes, lifting accessories, exercise balls and abdominal exercise equipments are some of the most commonly used exercise machines. These machines help to build body muscles, reduce excess fat production and retention, and improve cardiovascular conditioning.

Conventional exercise machines suffer from a number of limitations. For example, one prior art, described in U.S. Pat. No. 4,762,317 issued to Camfield describes a stationary exercise device having an elongated base frame, a seat and an exercise cycle assembly. The device also doubles as a rowing machine. The exercise cycle assembly includes pedals positioned to be reached by the feet of a human operator sitting on the seat. However, the device is designed only for performing abdominal exercises.

U.S. Pat. No. 6,413,192 issued to Abelbeck describes an exercise device capable of providing aerobic exercise and abdominal muscle conditioning. The device comprises an upper frame and a lower frame. The upper frame includes a seat back that supports the upper portion of the torso of a user. The lower frame includes a pelvis support and a bicycle pedaling mechanism. The preferred embodiment includes a linkage system that connects the upper frame to the lower frame. This linkage is capable of providing a translating center of rotation when the upper frame rotates with respect to the lower frame. This is done to follow the body's translating center of rotation during trunk flexion Even so, this device has a bulky structure and requires frequent maintenance.

U.S. Patent Application No. 20060287167 entitled to Bingham describes a recumbent bike having a crank cycle in which a relatively high level of power can be inputted.

Consequently, the potential exists for a user to experience a high cardiovascular load with less fatigue or other muscular difficulties. Improvements over conventional approaches are achieved, among other things, through the enhanced seat positioning relative to the crank axis of the bike. But, this exercise device is not designed to provide abdominal exercise.

Therefore, there is a need for a device that would simultaneously provide cardiac and abdominal exercise. Such a needed device would burn excess body fat, build body muscle and provide cardiovascular conditioning at the same time. Further, such a device would remove the need to work on separate devices to perform multiple exercises. The present invention accomplishes these objectives.

SUMMARY OF THE INVENTION

The present invention is an exercise bike to perform cardiac workout and abdominal workout simultaneously. The exercise bike includes a frame structure, a resistance provider, a pair of pedals, a first sprocket, a second sprocket, a sprocket rotating means, an axis, an engaging means, a cable, a seat, a seat adjusting means, an elastic band, a swing arm, a pair of shoulder straps, a monitor and a plurality of connecting means. The frame structure includes a front portion, a middle portion, a rear portion and a base portion. The exercise bike further includes a pair of legs at the base portion to support the exercise bike on a surface. The seat mounted on a seat supporting structure at the rear portion includes a back rest and a pair of armrests to support a user while performing exercise. The monitor mounted on a monitor stand at the middle portion provides an updated exercise status to the user.

The swing arm in the rear portion is at a same height level with the shoulders of the user seated on the seat. The swing arm is designed to connect with elastic band through the plurality of pulley wheels in such a way that the elastic band swings along the swing arm. The pair of shoulder straps designed to insert along the shoulders of the user is connected to the cable through the elastic band utilizing the plurality of connecting means. The second sprocket is connected to the first sprocket through the engaging means and is designed to rotate with the first sprocket. The sprocket rotating means allows the first sprocket to engage and disengage with the exercise bike. In the engaged state of the first sprocket, the user can perform both the cardiac workout and the abdominal workout. And in the disengaged state, the user can perform only the cardiac workout. The axis is mounted at the front portion and rotates with the second sprocket. The pedaling of the pair of pedals initiates the cardiac workout and rotates the first sprocket, the second sprocket, the axis. The cable defines a pulley system and gets stretched by the rotation of the axis. The pair of shoulder straps connected to the cable through the elastic band creates a tensional force thereon by getting stretched with the pedaling of the exercise bike. The tensional force pulls the user backward and the user in turn resists the backward movement by manually contracting abdominal muscles to perform the abdominal workout.

The present invention facilitates an efficient way for performing cardiac exercise and abdominal exercise simultaneously. Such the device allows to burn excess body fat and builds body muscle simultaneously. Further, the device removes the need to work on separate devices to perform multiple exercises and thus saves time. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
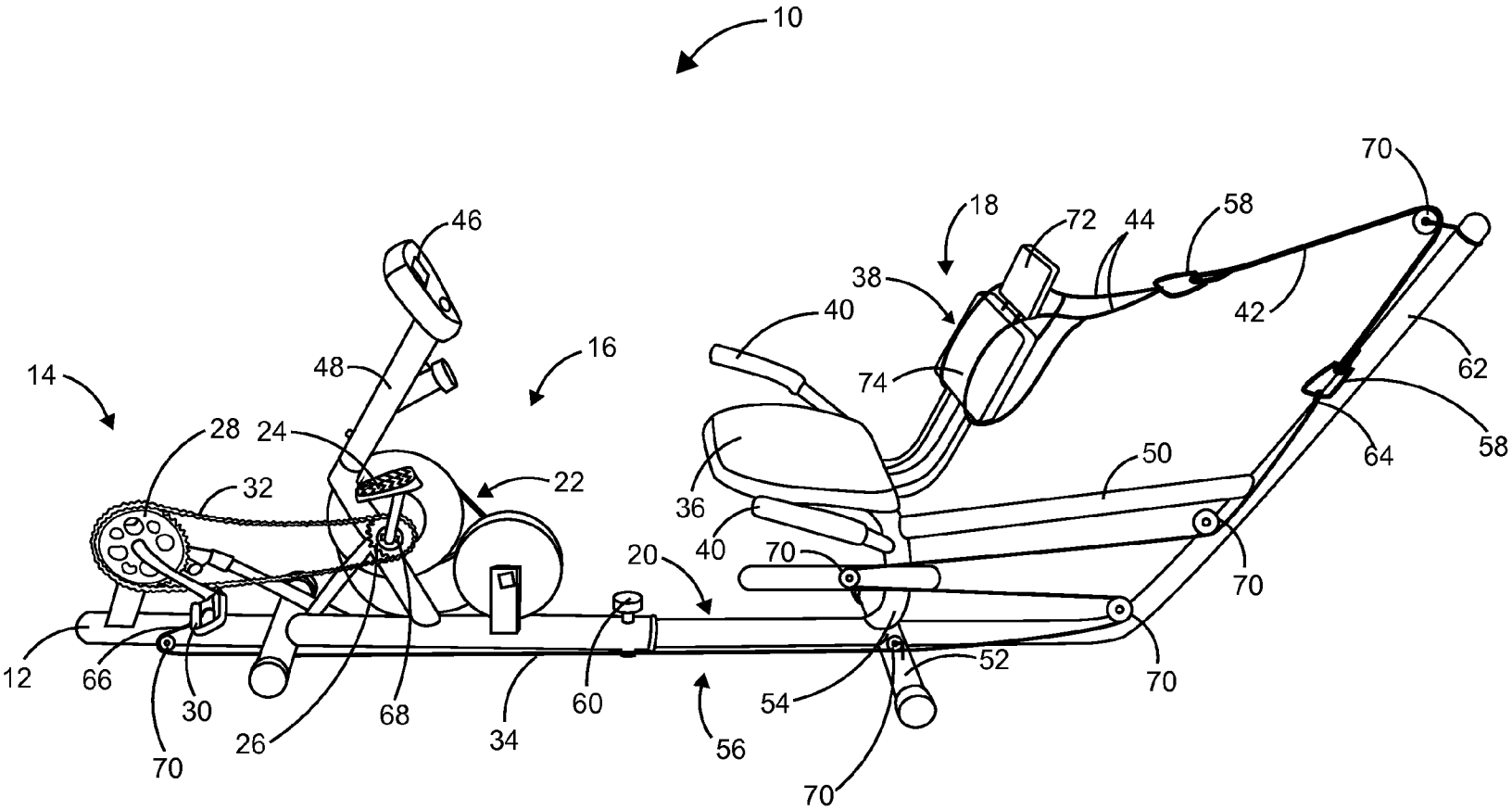
FIG. 1 is a perspective view of the invention, illustrating an exercise bike.

FIG. 1 is a perspective view of an exercise bike 10 adaptable to perform a cardiac workout and an abdominal workout simultaneously. The exercise bike 10 comprises a frame structure 12, a resistance provider 22, a pair of pedals 24, a first sprocket 26, a second sprocket 28, a sprocket rotating means 68, an axis 30, an engaging means 32, a cable 34, a seat 36, an elastic band 42, a seat adjusting means 60, a swing arm 62, a pair of shoulder straps 44, a monitor 46 and a plurality of connecting means 58. The frame structure 12 includes a front portion 14, a middle portion 16, a rear portion 18 and a base portion 20. The resistance provider 22 is located at the middle portion 16 of the frame structure 12. The pair of pedals 24 is mounted at the resistance provider 22.

The exercise bike 10 further comprises a pair of legs 52 at the base portion 20 to support the exercise bike 10 on a surface. The seat 36 mounted on a seat supporting structure 54 at the rear portion 18 includes a back rest 38 and a pair of armrests 40 to support a user while performing exercise. The back rest 38 includes an upper portion 72 and a lower portion 74 to provide a full back support to the user. When the upper portion 72 is removed or folded, the user can have a lower back support. Thus, the back rest 38 is customizable to provide both the upper back support and the lower back support to the user. The monitor 46 mounted on a monitor stand 48 at the middle portion 16 provides an updated exercise status to the user. The cable 34 includes a first end 64 and a second end 66. The first end of the cable 64 is connected to the elastic band 42 utilizing one of the plurality of connecting means 58 and the second end of the cable 66 is connected to the axis 30. The pulley system 56 includes a plurality of pulley wheels 70. The resistance provider 22 is designed to rotate with the pedaling of the pair of pedals 24. The resistance provider 22 is available in various shapes and structure, preferably as a wheel structure.

The swing arm 62 in the rear portion 18 is at a same level of height with the shoulders of the user seated on the seat 36. The swing arm 62 is designed to connect with the elastic band 42 through the plurality of pulley wheels 70 in such a way to swing the elastic band 42 along the swing arm 62. The swing arm 62 is connected to the seat 36 with a frame rod 50. The pair of shoulder straps 44 designed to insert along the shoulders of the user is connected to the first end of the cable 64 through the elastic band 42 utilizing the plurality of connecting means 58. The cable 34 may be made of materials selected from the group consisting of steel covered with plastic and a non elastic strong material like nylon. The plurality of connecting means 58 may be selected from a group consisting of carabiner, clamps, hooks and anchors.

Figure 2:
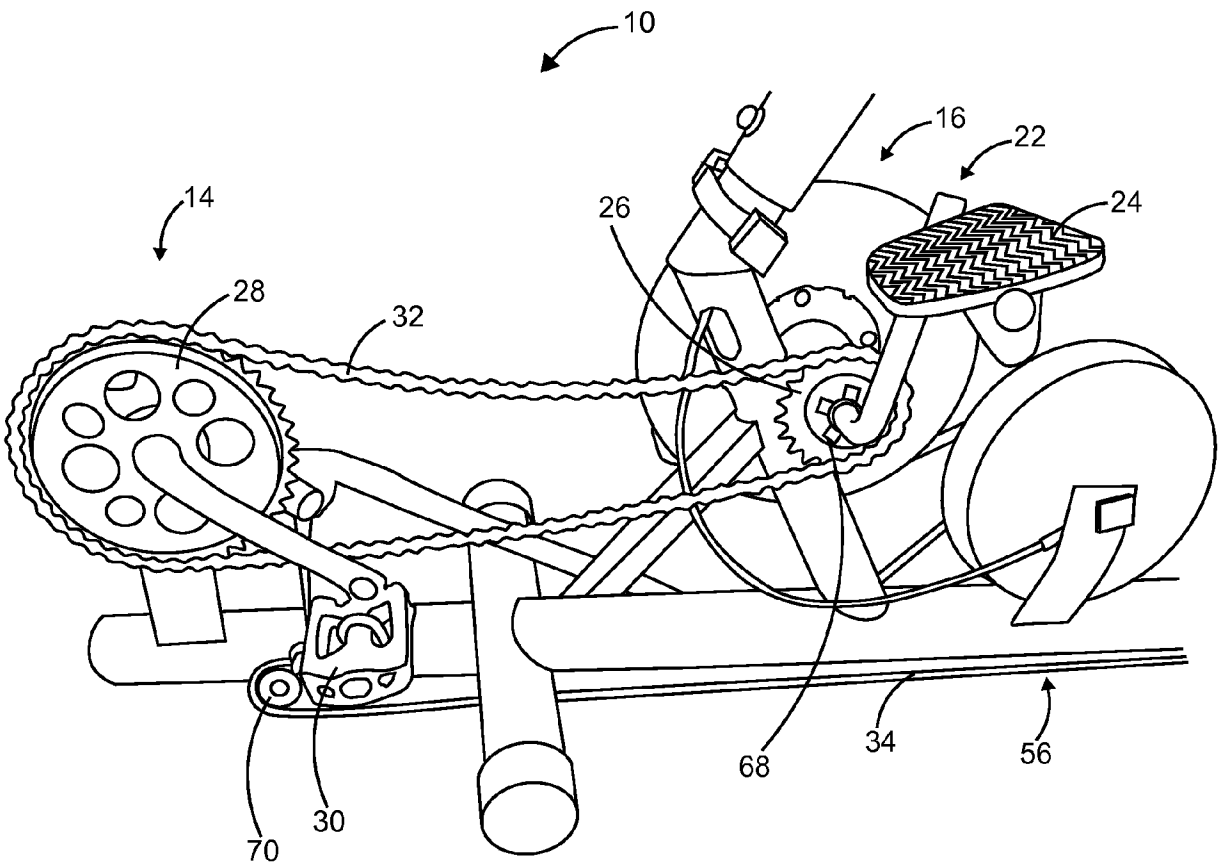
FIG. 2 is a perspective view of the invention, illustrating a front portion and a middle portion of a frame structure of the exercise bike.

Referring to FIG. 2, a perspective view of the front portion 14 and the middle portion 16 of the exercise bike 10 is illustrated. The first sprocket 26 mounted at the middle portion 16 and the second sprocket 28 mounted at the front portion 14 rotates through the engaging means 32. The engaging means 32 may be a chain. The first sprocket 26 is smaller than the second sprocket 28. The first sprocket 26 connected to the one of the pair of pedals 24 and the resistance provider 22 rotates with the pedaling of the pair of pedals 24. The pedaling of the exercise bike 10 allows the user to perform the cardiac workout. The second sprocket 28 is connected to the first sprocket 26 through the engaging means 32 and is designed to rotate with the first sprocket 26.

In the preferred embodiment, the sprocket rotating means 68 allows the first sprocket 26 to engage with the exercise bike 10. Engagement of the first sprocket with the exercise bike 10 initiates both the cardiac workout and the abdominal workout. In the engaged state, the sprocket rotating means 68 will be connected to both the first sprocket 26 and the one of the pair of pedals 24 so as to rotate the first sprocket 26 with the pedaling of the pair of pedals 24. The exercise bike 10 is customizable to perform the cardiac workout only. This can be achieved using several methods. One such method is to disengage the sprocket rotating means 68 from the exercise bike 10. In the disengaged state, the first sprocket 26 will not be connected to the sprocket rotating means 68 and the user can perform the cardiac workout only. The sprocket rotating means 68 may be a prong. The sprocket rotating means 68 is designed to have different types of movements such as from side to side and horizontal movement. The first sprocket 26 includes a plurality of holes (not shown) to receive the sprocket rotating means 68. The axis 30 is mounted at the front portion 14 and rotates along with the second sprocket 28. The cable 34 defines a pulley system 56 and gets stretched by the rotation of the axis 30. The plurality of pulley wheels 70 allows the cable 34 to move smoothly and pulls the pair of shoulder straps 44 back and forth through the pulley system 56.

As shown in FIGS. 1 and 2, the elastic band 42 creates a tensional force thereon by getting stretched with the pedaling of the exercise bike 10. The pair of shoulder straps 44 connected to the elastic band 42 gets stretched with the tensional force and pulls the user backward. The user resists this backward movement by manually contracting abdominal muscles to perform the abdominal workout. The user is pulled back by the tensional force through the cable 34 and the pulley system 56. In this way the exercise bike 10 allows to perform the cardiac workout and the abdominal workout simultaneously.

The second sprocket 28 and the axis 30 carry most of the pressure of the abdominal workout and are connected to the frame structure 12. The abdominal resistance for the abdominal workout can be made harder or easier by using one of the plurality of pulley wheels 70 positioned under the seat 36. The one of the plurality of pulley wheels 70 under the seat 36 is designed to move forward and backward depending upon the movement of the cable 34. As the one of the plurality of pulley wheels 70 moves, the distance for the cable changes and the elastic band 42 stretches to make the resistance harder.

The seat adjusting means 60 at the base portion 20 is utilized to adjust the distance of the seat 36 from the pair of pedals 24. Since the seat 36 and the seat adjusting means 60 are located at the base portion 20, adjusting the position of the seat adjustment means 60 makes it easy to move the seat 36 forward and backward. Thus, the exercise bike 10 suits well for people having different heights. The exercise bike 10 allows the user to stay steady at the seat 36 while resisting the tensional force to provide a passive workout without moving the body and adjusts resistance of the abdominal workout to a desired level. The exercise bike 10 provides a single method to burn excess body fat and build body muscle simultaneously. The mechanism applied to achieve the abdominal workout can be added to any exercise bike with different resistance mechanisms.

Figure 3:
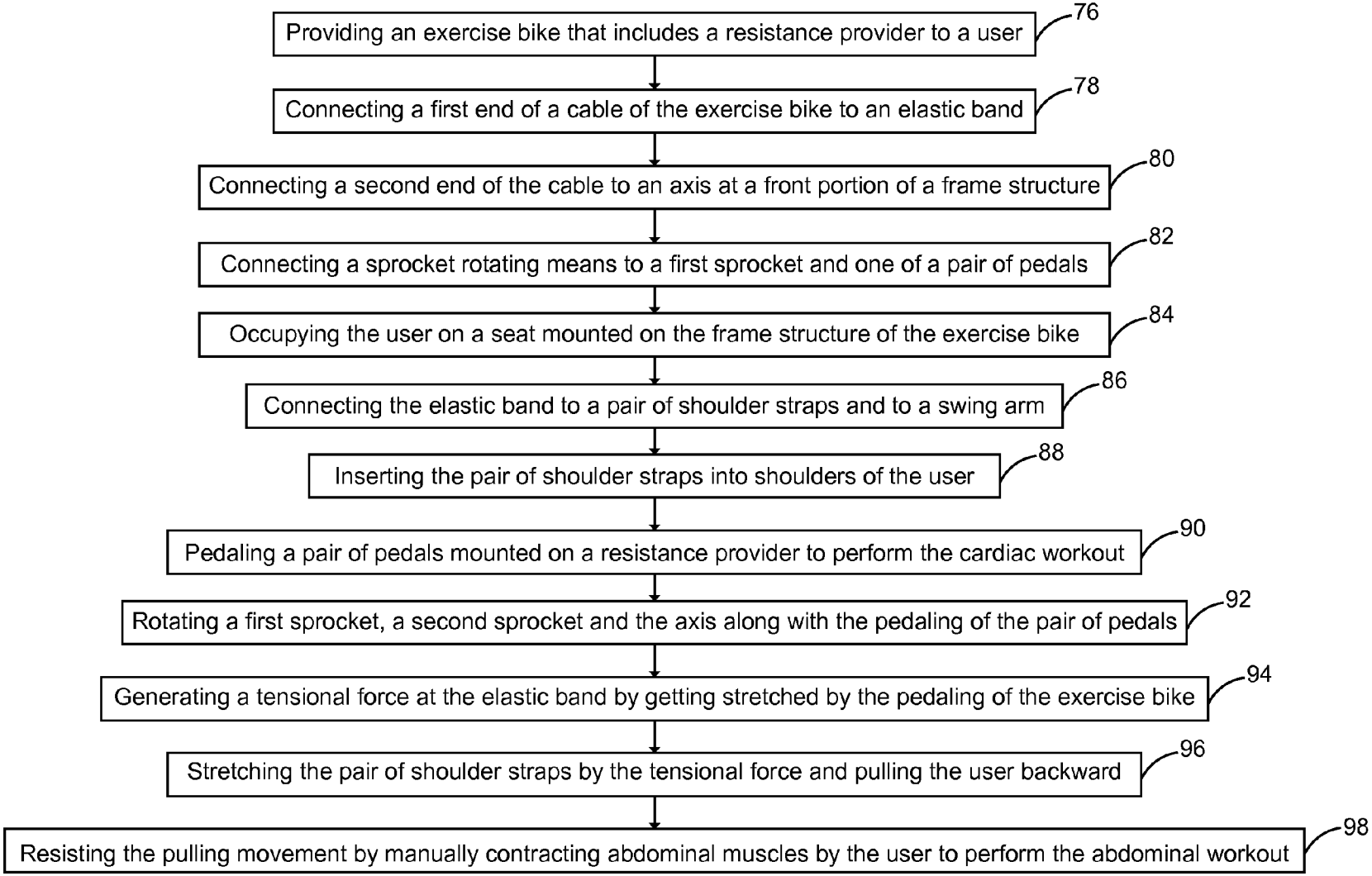
FIG. 3 is an operational flowchart of the invention, illustrating a method for performing a cardiac workout and an abdominal workout simultaneously utilizing the exercise bike.

FIG. 3 shows an operational flowchart of a method for performing cardiac workout and the abdominal workout simultaneously utilizing an exercise bike. In this method, as shown in block 76, the exercise bike that includes a resistance provider is provided to a user. A first end of a cable is connected to an elastic band as shown in block 78. Thereafter, a second end of the cable is connected to an axis as indicated at block 80. Next, a sprocket rotating means is connected to a first sprocket and one of a pair of pedals as shown in block 82. The user is securely occupied at a seat as indicated at block 84. The elastic band is connected to a pair of shoulder straps and to a swing arm as shown in block 86. As indicated at block 88, the pair of shoulder straps is inserted into the shoulders of the user. The user pedals the pair of pedals to perform the cardiac workout as shown in block 90. The pedaling of the exercise bike rotates a resistance provider, the first sprocket, a second sprocket and the axis as shown in block 92. As shown in block 94, a tensional force is generated at the elastic band. The pair of shoulder straps gets stretched by the tensional force and pulls the user backward utilizing the tensional force as indicated at block 96. The user resists the pulling movement by manually contracting the abdominal muscles to perform the abdominal workout as shown in block 98.

While a particular form of the invention has been illustrated and described, it will be apparent that various modifications can be made without departing from the spirit and scope of the invention. For example, the resistance provider 22, monitor 46 and the seat adjusting means 60 may be constructed into a single unit which can be added to any type of conventional recumbent exercise bikes. Accordingly, it is not intended that the invention be limited, except as by the appended claims.

What is claimed is:

1. An exercise bike adaptable to perform a cardiac workout and abdominal workout simultaneously, the exercise bike comprising:

a frame structure having a front portion, a middle portion, a rear portion and a base portion;

a pair of pedals at the middle portion to enable pedaling of the exercise bike to perform cardiac workout;

a resistance provider at the middle portion;

a first sprocket at the middle portion connected to one of the pair of pedals and the resistance provider, the first sprocket rotates with the pedaling of the pair of pedals;

a sprocket rotating means connected to the first sprocket and the one of the pair of pedals to rotate the first sprocket with the pedaling of the pair of pedals;

a second sprocket at the front portion connected to the first sprocket through an engaging means, the second sprocket rotates with the first sprocket;

an axis at the front portion and connected to the second sprocket, the axis being designed to rotate with the second sprocket;

a cable connected to the axis to define a pulley system having a plurality of pulley wheels, the cable includes a first end and a second end;

a seat mounted on a seat supporting structure at the rear portion, the seat includes a back rest and a pair of armrests;

a seat adjusting means at the base portion to adjust the position of the seat;

a monitor mounted on a monitor stand at the middle portion;

a pair of legs at the base portion to support the exercise bike on a surface;

an elastic band at the rear portion connected to the first end of the cable, the elastic band creates a tensional force thereon by getting stretched with the pedaling of the exercise bike;

a plurality of connecting means for connecting the elastic band with the cable;

a swing arm in the rear portion at a same level of height with the shoulders of a user seated on the seat, the swing arm being designed to connect with the elastic band through the plurality of pulley wheels in such a way that the elastic band swings along the swing arm; and a pair of shoulder straps connected to the elastic band and designed to insert along the shoulders of the user to stretch with the tensional force that pulls the user backward and allows the user to resist the backward movement by manually contracting abdominal muscles to perform the abdominal workout;

whereby the pedaling of the exercise bike initiates the cardiac workout and the sprocket rotating means initiates the first sprocket to rotate and subsequently stretches the pair of shoulder straps generating the tensional force that pulls the user backward and allows the user to manually contract the abdominal muscles to perform the abdominal workout.

2. The exercise bike of claim 1 wherein the monitor provides an updated exercise status to the user.

3. The exercise bike of claim 1 wherein the resistance provider is designed to rotate with the pedaling of the pair of pedals.

4. The exercise bike of claim 1 wherein the first sprocket and the second sprocket rotate through the engaging means.

5. The exercise bike of claim 1 wherein the cable is stretched by the rotation of the axis.

6. The exercise bike of claim 1 wherein the tensional force provided through the cable and the pulley system is configured to pull the user back.

7. The exercise bike of claim 1 wherein the first sprocket includes a plurality of holes to receive the sprocket rotating means.

8. The exercise bike of claim 1 wherein the sprocket rotating means may allow the first sprocket to engage and disengage with the exercise bike.

9. The exercise bike of claim 1 wherein the user may perform both the cardiac workout and the abdominal workout when the first sprocket is engaged with the exercise bike.

10. The exercise bike of claim 1 wherein when the sprocket rotating means is connected to the first sprocket and the one of the pair of pedals, the first sprocket rotates with the pedaling of the pair of pedals and initiates the abdominal workout.

11. The exercise bike of claim 1 wherein the exercise bike is customizable to perform the cardiac workout only by disconnecting the sprocket rotating means from the exercise bike.

12. The exercise bike of claim 1 wherein the plurality of connecting means may be selected from a group consisting of carabiner, clamps and hooks.

13. The exercise bike of claim 1 wherein the exercise bike allows to burn excess body fat and to build body muscle simultaneously.

14. A method for performing a cardiac workout and abdominal workout simultaneously utilizing an exercise bike, the method comprising the steps of:

a) providing the exercise bike that includes a resistance provider to a user;

b) connecting a first end of a cable of the exercise bike to an elastic band;

c) connecting a second end of the cable to an axis at a front portion of a frame structure;

d) connecting a sprocket rotating means to a first sprocket and one of a pair of pedals;

e) occupying the user on a seat mounted on the frame structure of the exercise bike;

f) connecting the elastic band to a pair of shoulder straps and to a swing arm;

g) inserting the pair of shoulder straps along shoulders of the user;

h) pedaling a pair of pedals mounted on the resistance provider at a middle portion of the frame structure to perform the cardiac workout;

i) rotating the resistance provider, a first sprocket, a second sprocket and the axis along with the pedaling of the pair of pedals;

j) generating a tensional force at the elastic band by getting stretched by the pedaling of the exercise bike;

k) stretching the pair of shoulder straps by the tensional force and pulling the user backward; and l) resisting the pulling movement manually by contracting abdominal muscles by the user to perform the abdominal workout.

15. The method of claim 14 wherein the first sprocket and the second sprocket are connected through an engaging means.

16. The method of claim 14 wherein the sprocket rotating means may allow the first sprocket to engage and disengage with the exercise bike.

17. The method of claim 14 wherein the user may perform both the cardiac workout and the abdominal workout when the first sprocket is engaged with the exercise bike.

18. The method of claim 14 wherein when the sprocket rotating means is connected to the first sprocket and the one of the pair of pedals, the first sprocket rotates with the pedaling of the pair of pedals and initiates the abdominal workout.

19. The method of claim 14 wherein the exercise bike is customizable to perform the cardiac workout only by disconnecting the sprocket rotating means from the exercise bike.

20. The method of claim 14 wherein the method allows the user to stay steady in the seat while resisting the tensional force to provide a passive workout without moving the body.

* * * * *